US005771912A

United States Patent [19]

Swetish

[11] Patent Number: 5,771,912

[45] Date of Patent: Jun. 30, 1998

[54] ATTACHMENT DEVICE FOR ERECTING A TENT

[75] Inventor: Thomas R. Swetish, Kenosha, Wis.

[73] Assignee: Johnson Worldwide Associates Inc., Sturtevant, Wis.

[21] Appl. No.: 643,418

[22] Filed: May 8, 1996

[51] Int. Cl.[6] ..... E04H 15/32

[52] U.S. Cl. ..... 135/87; 135/97; 135/127; 135/119; 135/120.3; 135/120.4; 135/114; 135/115; 135/117; 135/909; 24/116 A; 403/300

[58] Field of Search ..... 135/91, 92, 93, 135/127, 124, 136, 138, 140, 119, 120.3, 120.4, 120.1, 114, 118, 115, 117, 97, 909; 24/116 A, 128; 403/171, 176, 300, 305

[56] References Cited

U.S. PATENT DOCUMENTS

| | | | |
|---|---|---|---|
| 20,809 | 7/1858 | Manny . | |
| 152,236 | 6/1874 | Lodde . | |
| 236,580 | 1/1881 | Haworth . | |
| 294,228 | 2/1884 | Hanlon . | |
| 788,791 | 5/1905 | Peralta . | |
| 1,820,412 | 8/1931 | Warren . | |
| 2,543,684 | 2/1951 | Blanchard . | |
| 2,893,411 | 7/1959 | Birch | 135/114 |
| 3,465,764 | 9/1969 | Huddle . | |
| 3,941,140 | 3/1976 | Beavers . | |
| 4,026,312 | 5/1977 | Beavers | 135/120.4 X |
| 4,165,757 | 8/1979 | Marks | 135/93 |
| 4,195,651 | 4/1980 | Watts et al. . | |
| 4,236,543 | 12/1980 | Moss | 135/127 X |
| 4,637,416 | 1/1987 | McFarlin | 135/114 X |
| 4,723,371 | 2/1988 | Williams | 135/127 X |
| 4,745,936 | 5/1988 | Scheror | 135/127 |
| 4,941,422 | 7/1990 | Muller . | |
| 5,035,667 | 7/1991 | Haley | 24/116 A |
| 5,333,634 | 8/1994 | Taylor . | |
| 5,409,330 | 4/1995 | Naines et al. | 403/300 X |

FOREIGN PATENT DOCUMENTS

| | | | |
|---|---|---|---|
| 1040978 | 10/1953 | France | 135/136 |
| 1461516 | 12/1966 | France | 135/140 |

*Primary Examiner*—Wynn E. Wood
*Attorney, Agent, or Firm*—Foley & Lardner

[57] ABSTRACT

An attachment system, for erecting a tent having a flexible tent shell and a tent pole cooperating with the tent shell, includes a securing cord attached to a portion of the tent shell and a claw disposed at an end of the pole. The attachment system further includes an enlarged region disposed along the securing cord, which engages the claw, thereby retaining the tent shell in an extended position. The tent may also include a tent fly having an attached fly cord. An enlarged region disposed along the fly cord engages the claw to secure the tent fly.

24 Claims, 5 Drawing Sheets

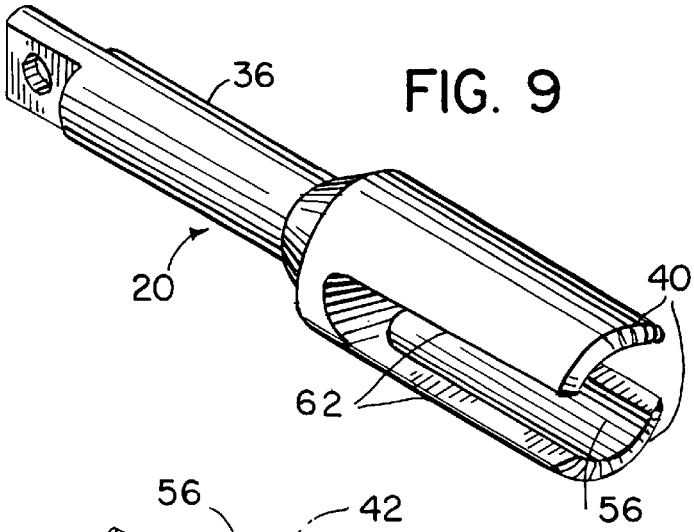
FIG. 9
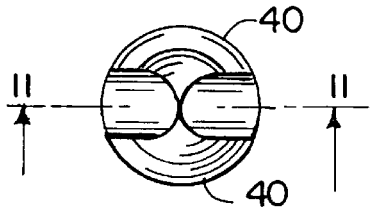
FIG. 10
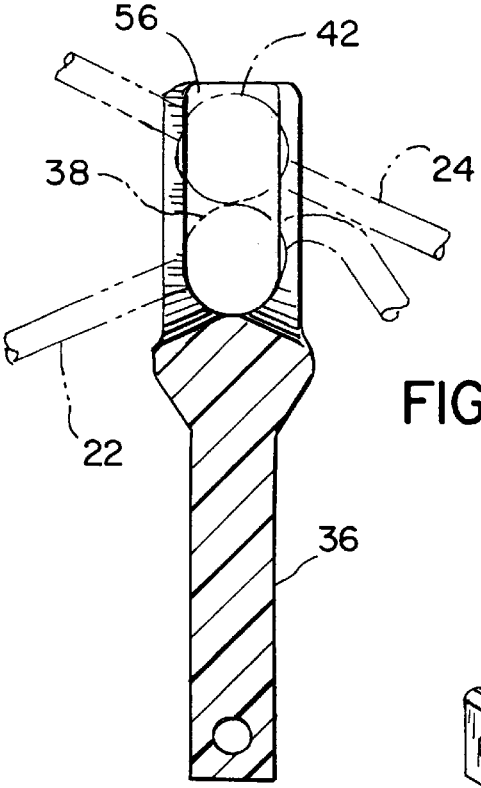
FIG. 11
FIG. 12
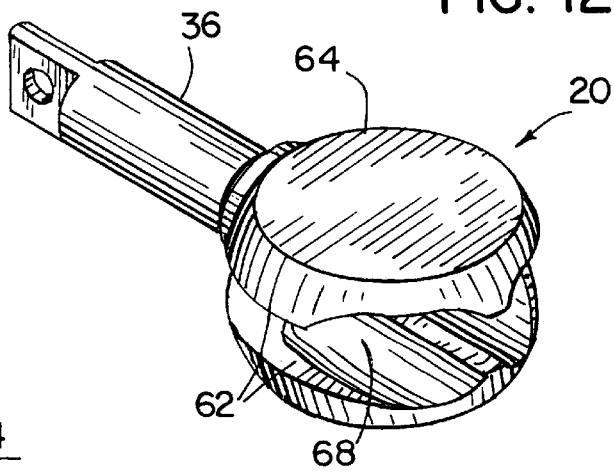
FIG. 13
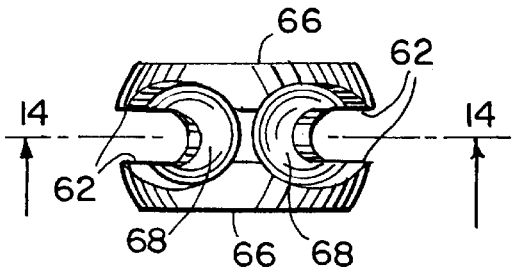

FIG. 19
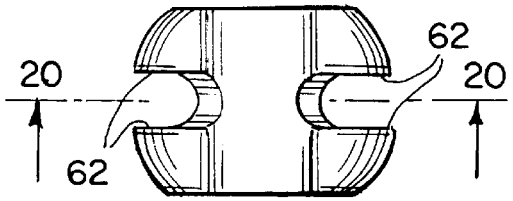
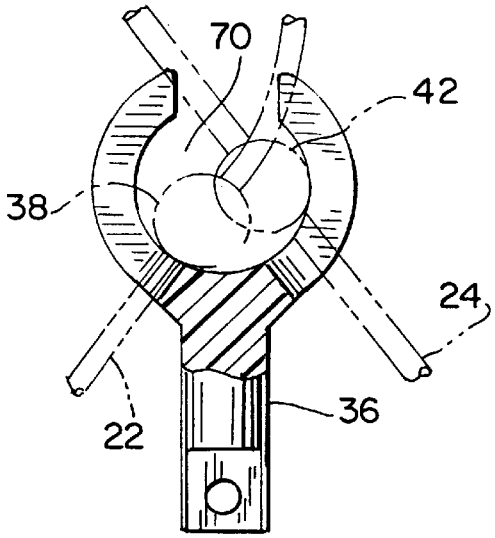
FIG. 20
FIG. 21
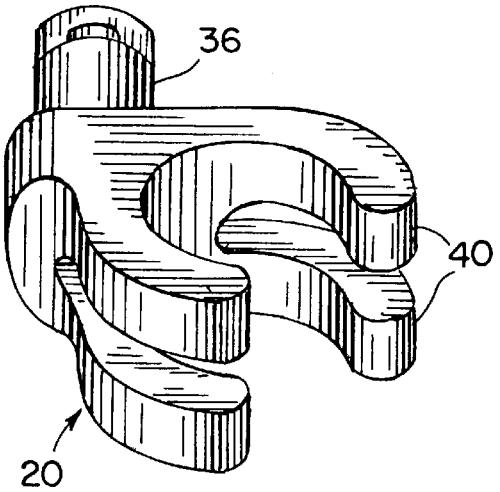

ATTACHMENT DEVICE FOR ERECTING A TENT

BACKGROUND OF THE INVENTION

This invention relates generally to self-supporting tents. More particularly, this invention relates to a tent pole attachment system for erecting such tents.

Self-supporting tents have long been in use. Such tents typically are erected by feeding flexible tent poles through sleeves, loops or clips that are sewn to the tent shell. The tent poles are secured by attaching the ends of the poles at regions near the base of the shell. The tent can then be left free-standing or can be staked to a surface. In addition, such tents may also include a fly draped over the tent shell and secured to the attachment regions near the base. Known structures that have been used to secure the ends of the poles, stake out the tent, and secure the tent fly, include the ring and pin, and the post and grommet.

The ring and pin structure comprises a short loop of flat webbing sewn to each corner of the tent shell. A metal pin is attached to a coiled ring connected to the loop. The tent pole is secured by inserting a free end of the metal pin into an end of the pole. By attaching additional pins to the ring, multiple tent poles can be secured. The tent fly also can be secured by attachment to a hook or a side release buckle connected to the ring. If desired, the tent may be staked out through the ring. The ring and pin structure has the advantages of being strong and lightweight, as well as versatile in that the tent pole may be set up in a variety of positions. However, the ring and pin structure is very cumbersome, and thus disadvantageous, especially when a user's hands are cold. Another disadvantage is that the tension in the tent poles cannot be adjusted. Further, the aesthetic effect of the structure when set up is not optimal because of the tensions exerted in multiple directions by the various attached elements. Moreover, although the flat webbing can flex up and down, it cannot bend from side to side without creating stress at the region the webbing is attached to the tent. This stress can eventually cause the webbing to detach from the tent or tear the tent fabric in the vicinity of the stitching. Because of these disadvantages, the industry generally regards the ring and pin structure as a low-end solution.

A second structure, the post and grommet, incorporates long loops of flat webbing sewn to the base of the tent. The tent pole is secured by inserting a post, coupled to the end of the pole, into one of a plurality of grommets in the webbing. Stakes can be driven through another grommet to anchor the tent to a surface. The fly can be secured by attaching it to a side release buckle sewn on the webbing. The post and grommet structure advantageously allows adjustment of the tent pole tension by proper selection of the grommet in which the post is placed. The structure also is relatively simple and strong. However, motion of the tent poles is transferred directly to the webbing, thus often causing the grommets to tear out. Further, the post and grommet structure does not address the problem of the flat webbing detaching from the tent or the tent fabric ripping due to stresses at the attachment region.

To overcome the disadvantages of the ring and pin and the post and grommet structures, alternative devices have been proposed. For example, in one known design, a molded plastic piece is attached to a loop of flat webbing sewn to each tent corner. The plastic piece has a hole, similar to the grommet described above, for accepting a post coupled to the end of a tent pole. However, although this arrangement does present advantages over the other structures discussed above, the arrangement does not eliminate the problems associated with stresses at the region the structure is attached to the tent. Thus, there is a need for a simple, strong and lightweight structure for securing tent poles, staking out the tent, and attaching the tent fly. The structure must be easy to use, permit adjustment of the tension of the tent poles, secure the tent fly, and eliminate the stresses at the region the structure is attached to the tent.

SUMMARY OF THE INVENTION

The present invention provides an improved tent pole structure for erecting a tent. The tent pole structure is configured to secure an end of the tent pole, to provide a region to stake out the tent, as well as to attach a tent fly. The tent pole structure has the advantages of permitting adjustment of the tension of the tent poles, securing the tent fly, and eliminating or reducing the stresses on the structure at the region of attachment to the tent.

Thus, in accordance with a first aspect of the invention, in a tent having a shell made of a flexible material and a pole cooperating with the shell to hold the flexible material in an extended position, an attachment structure comprises a securing cord attached to the shell, an enlarged region disposed along the securing cord, and a claw disposed at an end of the pole. The claw includes a plurality of fingers to engage the enlarged region of the securing cord.

In accordance with another aspect of the invention, a pole for erecting a tent is provided. The tent includes a shell made of a flexible material and a cord secured to the shell, the cord having an enlarged region configured to cooperate with the pole. The pole comprises an end and a claw coupled with the end of the pole. The claw includes a plurality of fingers to engage the enlarged region of the cord.

In accordance with a further aspect of the invention, an attachment for erecting a tent is provided. The tent includes a shell made of a flexible material, a pole engaged with the shell and a claw disposed proximate an end of the pole. The claw and the pole cooperate with the shell to hold the flexible material in an extended position. The attachment comprises a cord and an enlarged region disposed along the cord that has a substantially round cross-section and is secured to the shell. The enlarged region of the cord engages the claw.

BRIEF DESCRIPTION OF THE DRAWINGS

FIG. 9 is a perspective view of a first alternative embodiment of the claw;

FIG. 10 is a bottom plan view of the claw of FIG. 9;

FIG. 11 is a sectional view of the claw of FIG. 10 along the line 11—11, showing the securing cord and the fly cord engaged with the claw;

FIG. 12 is a perspective view of a second alternative embodiment of the claw;

FIG. 13 is a bottom plan view of the claw of FIG. 12;

FIG. 19 is a bottom plan view of the claw of FIG. 18;

FIG. 20 is a partial sectional view of the claw of FIG. 19 along the line 20—20; and FIG. 21 is a perspective view of a fifth alternative embodiment of the claw.

DETAILED DESCRIPTION OF THE PREFERRED EMBODIMENTS

Figure 1:
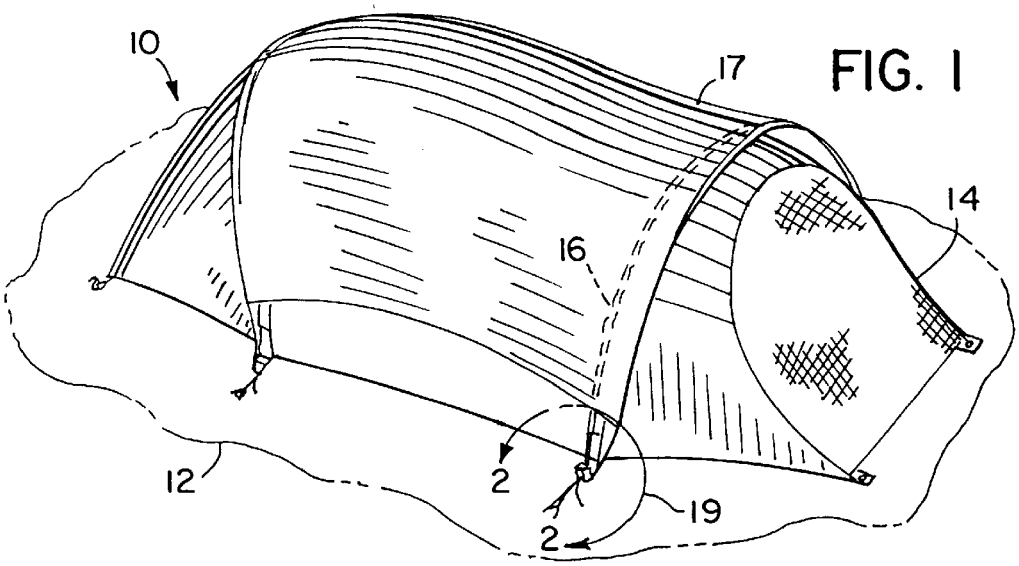
FIG. 1 is a perspective view of an erected tent shell covered by a tent fly, embodying an attachment structure for erecting the shell and securing the fly, including a flexible tent pole, a claw, a securing cord and a fly cord.

Turning now to the drawings and referring to FIG. 1, a tent 10 is illustrated staked to a surface 12. Tent 10 includes a tent shell 14 that is held in an extended position by at least one tent pole 16. Tent shell 14 is preferably made of a flexible material, such as nylon or canvas. In the preferred embodiment shown, tent 10 further includes a tent fly 17 draped over tent shell 14. Among other functions, tent fly 17, which also is made of a flexible material, such as nylon or canvas, protects tent shell 14 from moisture and falling objects. As shown in detail in FIG. 2, tent shell 14, tent pole 16 and tent fly 17 are secured at an attachment region 19 located proximate the base of tent 10.

Figure 2:
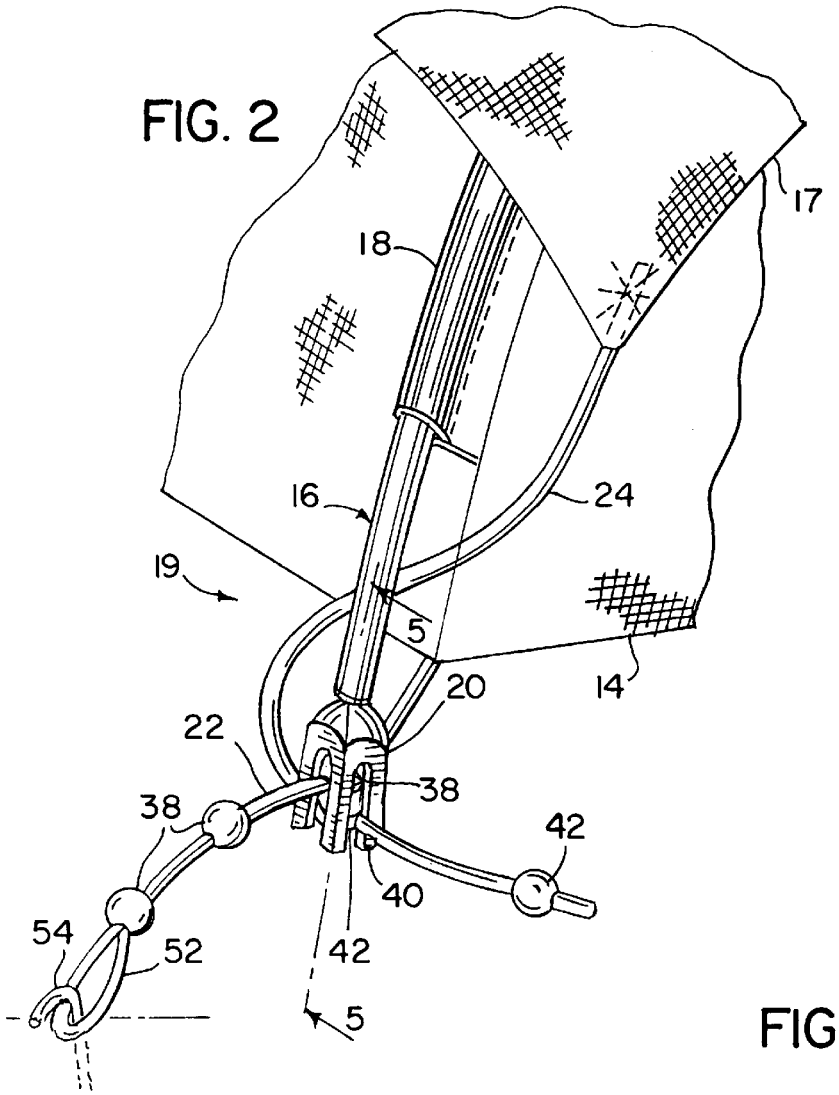
FIG. 2 is a detailed view of the embodiment of FIG. 1 in the region 2—2, illustrating the elements of the attachment structure.

Referring to FIG. 2, the detail of attachment region 19 is illustrated. To erect tent 10, tent pole 16 is threaded through a sleeve 18 attached to the exterior of tent shell 14. Tent pole 16 terminates in a claw 20. Claw 20 secures tent pole 16 by engaging a securing cord 22 attached to tent shell 14. Tent fly 17 includes a fly cord 24 which also is secured by engagement with claw 20.

As discussed above, sleeve 18 is attached to the exterior of tent shell 14. Sleeve 18 may be an integral part of tent shell 14, but preferably comprises a single loop or a plurality of loops sewn to tent shell 14 in a conventional manner. Sleeve 18 is made of a flexible material, such as nylon, canvas, or webbing. Alternatively, sleeve 18 may be a clip or plurality of clips attached to tent shell 14.

Figure 3:
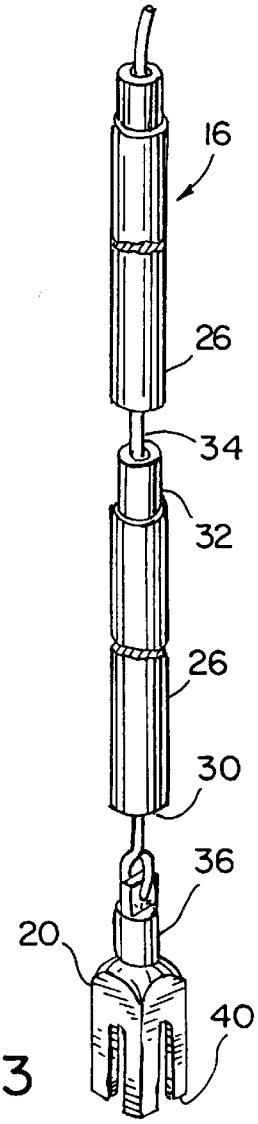
FIG. 3 is a perspective view of sections of a tent pole extended against the biasing of a shock cord contained therein, illustrating the interconnection of the ends of the tent pole, as well as the coupling of the claw.
Figure 5:
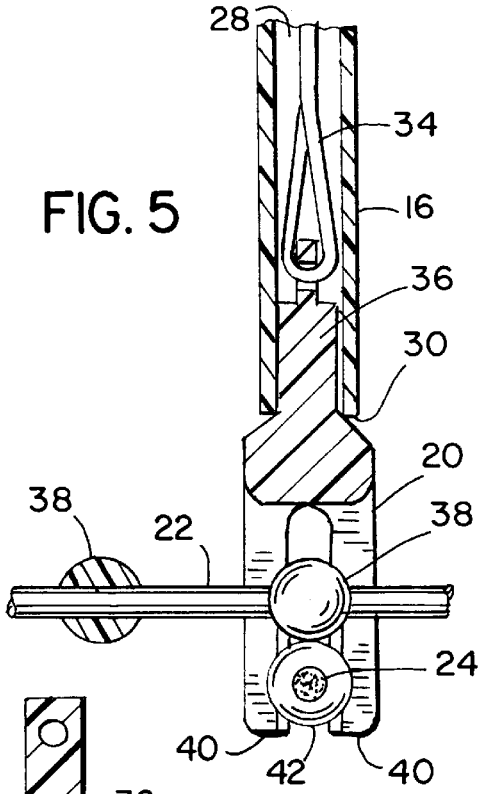
FIG. 5 is a partial sectional view of the attachment structure of FIG. 2 along the line 5—5, illustrating the engagement of the securing cord and the fly cord with the claw and the coupling of the claw with the tent pole.

Referring now to FIG. 3, tent pole 16 preferably is formed of a plurality of interconnected sections 26 having a hollow interior 28 and is made of a flexible, lightweight material, such as aluminum or fiberglass. As is well known to one skilled in the art, each section 26 of tent pole 16 includes a female end 30 which accepts a male end 32 of an adjacent section 26. The male end 32 and female end 30 are urged together by an elastic shock cord 34 held under tension within the hollow interior 28 of tent pole 16. In the preferred embodiment, an end of shock cord 34 attaches to a shank 36 of claw 20. Upon interconnecting the plurality of sections 26, shock cord 34 retracts shank 36 into the hollow interior 28 of female end 30 of tent pole 16 as shown in FIG. 5. Various alternative structures will occur to those skilled in the art for coupling claw 20 to tent pole 16, such as by a hollow collar which is crimped, or otherwise adhered, about the exterior of an end of pole 16. A further alternative structure comprises a claw 20 having a female portion for receiving an end of tent pole 16. The bottom of the female portion includes a small opening through which shock cord 34 is anchored. After assembly of the sections 26 and as shown in FIG. 2, tent pole 16 then is threaded through sleeve 18, such that claw 20 is disposed near attachment region 19.

Referring to FIGS. 2 and 5, tent shell 14 and tent fly 17 cooperate with claw 20 via securing cord 22 and fly cord 24, respectively. As illustrated, an enlarged region 38 disposed along securing cord 22 engages a plurality of fingers 40 of claw 20. Likewise, an enlarged region 42 is disposed along fly cord 24 and engages fingers 40. Although only a single enlarged region 38 and a single enlarged region 42 may be provided, the preferred embodiment includes a plurality of such enlarged regions 38 and 42, which are preferably plastic beads molded to and spaced at fixed intervals along securing cord 22 and fly cord 24, respectively. Alternatively, enlarged regions 38 and 42 can be knots tied in cords 22 and 24. The plurality of enlarged regions 38 and 42 advantageously permits a user easily to adjust the tension in tent pole 16 and the tautness of tent fly 17. Adjustment is accomplished simply by engaging claw 20 with a different enlarged region 38 or 42 to pull shell 14 and fly 17 to the desired degree of tautness.

Figure 4:
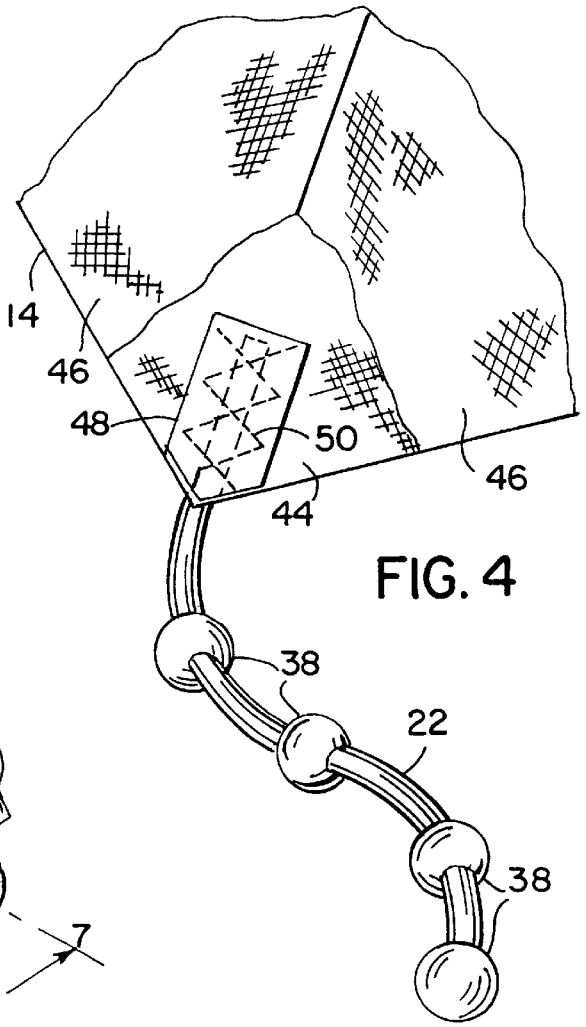
FIG. 4 is a detailed view of a corner of the tent shell of FIG. 2, showing the sides of the shell cut away to illustrate the attachment of the securing cord.

Referring now to FIG. 4, securing cord 22 is attached to a bottom portion 44 of tent shell 14, but alternatively may be attached to a side portion 46. In other embodiments, securing cord 22 may be sewn into a seam between two side portions 46 or between bottom portion 44 and side portion 46. As illustrated in FIG. 4, bottom portion 44 is reinforced with a fabric panel 48, such as nylon or canvas, and stitching 50 retains securing cord 22 thereon. Fly cord 24 is attached in a similar manner to a portion of tent fly 17.

To reduce stress on stitching 50 created by the flexing and pulling of cords 22 and 24 in various directions, cords 22 and 24 preferably have a substantially round cross-section. In the preferred embodiment, securing cord 22 is made of a substantially inelastic material, such as a polypropylene climbing rope. Further, securing cord 22 terminates in a loop 52, through which a stake 54 may be driven into surface 12 to anchor tent 10. Where only a single enlarged region 42 is disposed along fly cord 24, fly cord 24 preferably comprises a material having elastic properties, such as a shock cord. The elastic properties thus provide the range of adjustment necessary to draw tent fly 17 taut. However, as easily envisioned by one skilled in the art, cords 22, 24 may be made of many various materials. For example, cords 22, 24 and enlarged regions 38, 42 each may be molded as an integral piece from a material, such as plastic.

As will be appreciated by those skilled in the art, the use of a generally round cord 22 for securing shell 14 to claw 20 reduces stresses on shell 14 in the region cord 22 is attached. In particular, unlike conventional flat webbing attachment systems which tend to concentrate stresses toward one side edge of the webbing, particularly when the webbing is anchored in a direction out of alignment with its attached portion, cord 22 distributes loading on shell 14 in a generally uniform manner despite such misalignment. Moreover, although the claw structure described herein is preferred, it should also be noted that the advantages afforded by the use of round cord 22 may be achieved through the use of alternative structures for securing cord 22 to shell 14 and fly 17.

Figure 8:
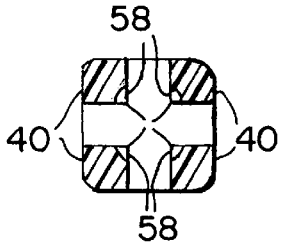
FIG. 8 is a sectional view of the claw shown in FIG. 7 along line 8—8.
Figure 7:
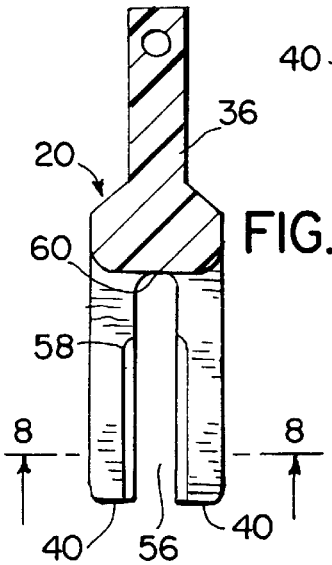
FIG. 7 is a sectional view of the claw shown in FIG. 6 along line 7—7.
Figure 6:
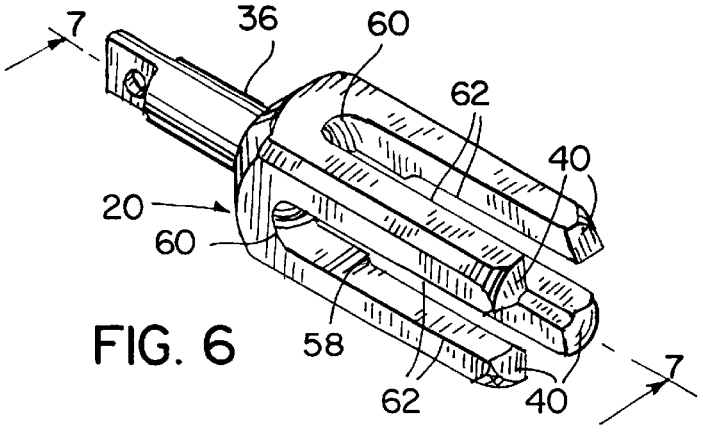
FIG. 6 is a perspective view of the claw shown in FIG. 2.

Referring now to FIGS. 6–8, a preferred embodiment of claw 20 is shown. Fingers 40 are arranged and shaped to form a cavity 56, having a substantially circular cross-section for receiving enlarged regions 38 and 42. Cavity 56 is sized such that the engagement with enlarged regions 38 and 42 is a snug fit. Fingers 40 further are arranged to form a plurality of slots 62 providing access through the sides of cavity 56. Thus, when enlarged regions 38 and 42 are inserted in cavity 56, securing cord 22 and fly cord 24 can pass through slots 62 permitting full engagement of regions 38 and 42 into cavity 56.

Fingers 40 also preferably form a shoulder 58, providing a stop beyond which enlarged regions 38 and 42 cannot move. Shoulder 58 is undercut and thus advantageously prevents a top edge 60 of slot 62 from rubbing and wearing against securing cord 22 and fly cord 24. As an alternative to providing shoulder 58, top edge 60 may be tapered to prevent the wear resulting from contact with a sharp surface. In the preferred embodiment, claw 20 is made of molded plastic, but also may be molded or machined from other suitable materials, such as aluminum.

FIGS. 9–11 illustrate an alternative embodiment of claw 20. In this embodiment, claw 20 includes shank 36 and two fingers 40, which form cavity 56 having a substantially circular cross-section for snugly receiving enlarged regions 38 and 42. Slots 62 allow securing cord 22 and fly cord 24 to pass through the sides of cavity 56. The top edges 60 of slots 62 are tapered to reduce the frictional wear on cords 22 and 24.

Figure 14:
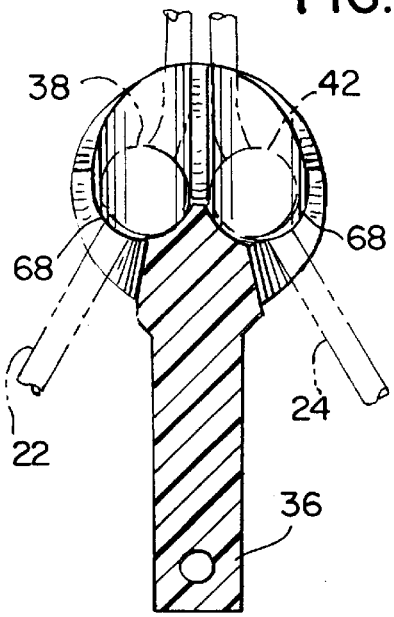
FIG. 14 is a sectional view of the claw of FIG. 12 along the line 14—14.

Referring to FIGS. 12–14, still a further embodiment of claw 20 is shown. In this embodiment, claw 20 includes shank 36 and a seating structure 64. Seating structure 64 includes two parallel facing discs 66 disposed to form two substantially spherical impressions 68 and two slots 62. Enlarged regions 38 and 42 are seated in impressions 68. Tension on cords 22 and 24, which pass through slots 62, retain enlarged regions 38 and 42 in position.

Figure 15:
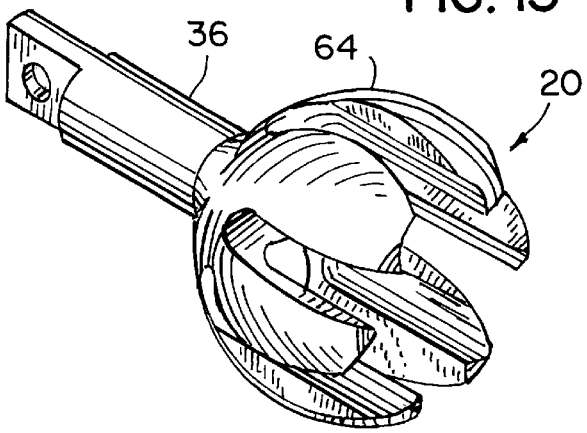
FIG. 15 is a perspective view of a third alternative embodiment of the claw.
Figure 16:
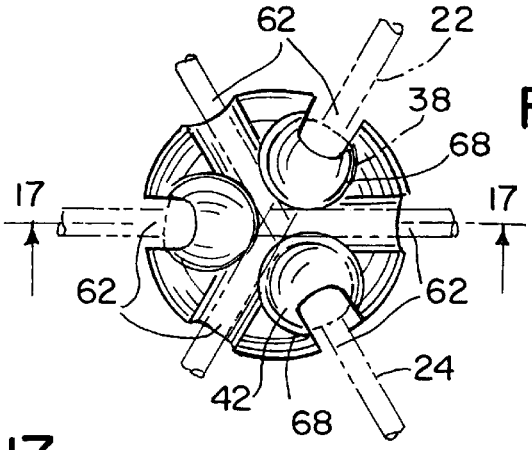
FIG. 16 is a bottom plan view of the claw of FIG. 15.
Figure 17:
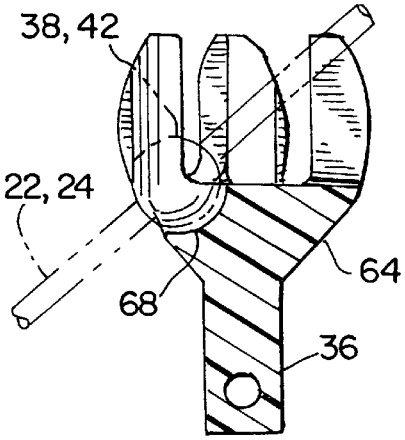
FIG. 17 is a sectional view of the claw of FIG. 16 along the line 17—17.

FIGS. 15–17 illustrate a variation of seating structure 64 shown in FIGS. 12–14, in which seating structure 64 is disposed to form three substantially spherical impressions 68 and six slots 62. Enlarged regions 38 and 42 are seated in spherical impressions 68. Cords 22 and 24 each extend through two slots 62 spaced substantially 180 degrees from one another. As evident from this variation, seating structure 64 may be arranged to secure other cords in addition to securing cord 22 and fly cord 24.

Figure 18:
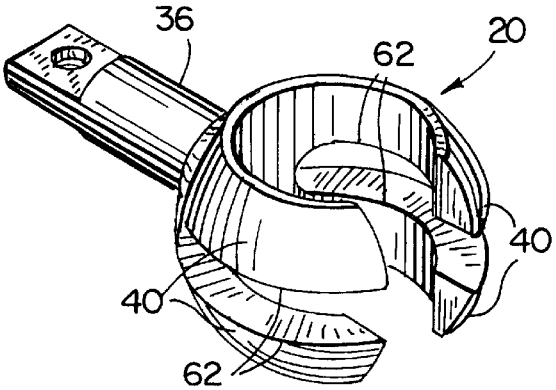
FIG. 18 is a perspective view of a fourth alternative embodiment of the claw.

FIGS. 18–20 show another alternative embodiment of claw 20. In this embodiment, claw 20 includes shank 36, fingers 40 and slots 62. Securing cord 22 and fly cord 24 pass through slots 62. Tension applied to cords 22 and 24 retain enlarged regions 38 and 42 within an open region 70 formed between fingers 40. FIG. 21 depicts a variation of the embodiment of claw 20 shown in FIGS. 18–20, illustrating shank 36 positioned at a different angle relative to fingers 40.

It should be noted that a further advantage procured by the use of claw 20, in any of its various forms, is to facilitate insertion and feeding of pole 16 through sleeve 18. In particular, claw 20 preferably presents rounded tips or a bulbous shape that slides easily through sleeve 18, preventing pole 16 from snagging on stitching, hems and the like along sleeve 18.

While the embodiments illustrated in the FIGURES and described above are presently preferred, it should be understood that these embodiments are offered by way of example only. The invention is not intended to be limited to any particular embodiment, but is intended to extend to various modifications that nevertheless fall within the scope of the appended claims. For example, further variants on the claw, other than those discussed above, can be envisioned, such as claws having different shapes or different numbers of fingers. Additionally, different tent pole configurations may be adapted to use with a claw. As a further example, the enlarged regions on the cords may not necessarily be substantially spherical in shape.

What is claimed is:

1. An attachment structure for a tent having a shell made of a flexible material and a pole cooperating with the shell to adjustably hold the flexible material in a tensioned position, the attachment structure comprising:

a securing cord attachable to the shell;

at least two enlarged regions disposed along the securing cord; and a claw disposable at an end of the pole to selectively engage the enlarged regions, the claw having a base portion and at least two fingers extending from the base portion, the at least two fingers having a slot therebetween, the slot configured to receive a portion of the securing cord and the at least two fingers arranged to selectively contact one of the plurality of enlarged regions, wherein the tensioned position of the flexible material is thereby adjusted.

2. The attachment structure as recited in claim 1, wherein each enlarged region is a bead.

3. The attachment structure as recited in claim 2, wherein each bead is made of a moldable plastic material.

4. The attachment structure as recited in claim 1, wherein the securing cord includes a loop for staking the tent to a surface.

5. The attachment structure as recited in claim 1, wherein the securing cord is a substantially nonelastic material.

6. The attachment structure as recited in claim 1, wherein the securing cord has a substantially round cross-section.

7. A tent having a shell made of a flexible material and a pole cooperating with the shell to hold the flexible material in an extended position, and comprising:

a securing cord attached to the shell;

a first enlarged region disposed along the securing cord;

a claw disposed at an end of the pole, the claw having a plurality of fingers to engage the first enlarged region;

a tent fly disposed over the shell;

a fly cord secured to the tent fly; and a second enlarged region disposed along the fly cord, the second enlarged region being engageable by the plurality of fingers of the claw.

8. A tent as recited in claim 7, wherein the fly cord is a shock cord.

9. A tent as recited in claim 8, wherein the first and second enlarged regions are beads.

10. A tent as recited in claim 9, wherein the beads are made of a moldable plastic material.

11. A tent comprising a pole for erecting a tent, the tent having a shell made of a flexible material and a securing cord secured to the shell, the securing cord having an enlarged region configured to cooperate with the pole, the pole comprising:

an end; and a claw coupled with the end of the pole to engage the enlarged region of the securing cord, the claw having a base portion and at least two fingers extending from the base portion, the at least two fingers having a slot therebetween, wherein the at least two fingers are arranged to contact the enlarged region and the slot is configured to receive a portion of the securing cord.

12. A tent as recited in claim 11, wherein the pole has a hollow interior, the pole further comprising a shock cord disposed inside the hollow interior.

13. A tent as recited in claim 12, wherein the claw includes a shank extending from the base portion, the shank being configured to attach to the shock cord.

14. A tent as recited in claim 11, wherein the enlarged region is a bead.

15. A tent as recited in claim 14, wherein the bead is made of a moldable plastic material.

16. A tent as recited in claim 11, wherein the tent includes a tent fly disposed over the shell, the tent fly having a fly cord secured thereto, and the fly cord having an enlarged region to engage the at least two fingers of the claw.

17. A tent as recited in claim 16, wherein the enlarged region of the fly cord is a bead.

18. A tent as recited in claim 17, wherein the bead is made of a moldable plastic material.

19. A tent comprising an attachment for erecting the tent, the tent having a shell made of a flexible material, a pole engaged with the shell, and a claw disposed proximate an end of the pole, the pole and the claw cooperating with the shell to hold the flexible material in an extended position, the attachment comprising:

a cord having a substantially round cross-section, the cord being permanently secured to the shell; and an enlarged region disposed along the cord, the enlarged region being engageable with the claw.

20. A tent as recited in claim 19, wherein the enlarged region is a bead.

21. A tent as recited in claim 20, wherein the bead is made of a moldable plastic material.

22. A tent as recited in claim 19, wherein the substantially round cord is a shock cord.

23. A tent as recited in claim 19, wherein the substantially round cord includes a loop for staking the tent to a surface.

24. The attachment structure as recited in claim 1, wherein the at least two fingers and the base portion define a cavity configured to receive the enlarged region.

* * * * *